US005973577A

United States Patent [19]

Karlsson

[11] Patent Number: 5,973,577

[45] Date of Patent: Oct. 26, 1999

[54] MICROWAVE SWITCH

[75] Inventor: Anders Karlsson, Saltsjö-Boo, Sweden

[73] Assignee: Sivers Lab AG, Kista, Sweden

[21] Appl. No.: 09/030,591

[22] Filed: Feb. 25, 1998

[30] Foreign Application Priority Data

Feb. 27, 1997 [SE] Sweden ..... 9700711

[51] Int. Cl.[6] ..... H01P 1/10

[52] U.S. Cl. ..... 333/106; 333/108; 333/259

[58] Field of Search ..... 333/105, 106, 333/108, 258, 259

[56] References Cited

U.S. PATENT DOCUMENTS

| | | | |
|---|---|---|---|
| 4,370,631 | 1/1983 | Gerber et al. | 333/106 |
| 4,617,538 | 10/1986 | Nelson | 333/106 |
| 4,938,653 | 7/1990 | Wirz | 414/744.2 |
| 5,748,055 | 5/1998 | Ors | 333/106 |

FOREIGN PATENT DOCUMENTS

| | | | |
|---|---|---|---|
| 0147610 | 7/1985 | European Pat. Off. . | |
| 59-86303 | 5/1984 | Japan | 333/106 |
| 1-181202 | 7/1989 | Japan | 333/106 |
| 1529319 | 12/1989 | U.S.S.R. | 333/258 |
| 1707659 | 1/1992 | U.S.S.R. | 333/106 |

*Primary Examiner*—Justin P. Bettendorf
*Attorney, Agent, or Firm*—Christie, Parker & Hale, LLP

[57] ABSTRACT

A microwave switch having a switch housing with side walls in which waveguide connections are arranged; a switch rotor rotatably arranged in the switch housing; a drive means arranged on the switch housing with a shaft for providing a moment for rotating the switch rotor; and a transmission arrangement arranged to transmit the moment of the drive means to the switch rotor. The transmission arrangement has a first link with a radially extended slot, and a second link fixed to the shaft and fitted with a guide member arranged to be slidably moved in the slot. Further provided is a first stop member fixedly connected to the switch rotor and arranged, in the respective switch position, to engage with a second stop member fixedly connected to the switch housing; and a means arranged to apply a torque to the switch rotor in order to press the stop members against each other.

16 Claims, 5 Drawing Sheets

MICROWAVE SWITCH

FIELD OF THE INVENTION

The present invention generally relates to a microwave switch. More specifically, the invention relates to a microwave switch comprising a switch housing with side walls in which waveguide connections are arranged;

a switch rotor which is rotatably arranged in the housing between a first switch position and a second switch position; a drive means which is arranged on the housing with a shaft for achieving a moment for rotating the switch rotor between said switch positions; and a transmission arrangement arranged to transmit the moment of the drive means to the switch rotor, the transmission arrangement comprising a first link, which is fixedly connected to the switch rotor and which comprises, in relation to the rotation shaft of the switch rotor, a radially extended slot which is defined by opposing guide surfaces, and a second link, which is fixed to the shaft, which is parallel to the rotation shaft of the switch rotor, and which is fitted with a guide member which is arranged to be slidably moved in said slot, the second link being arranged to form an essentially 90° angle to the first link in the two switch positions.

The invention thus relates to such a microwave switch which utilizes a so-called Maltese mechanism for achieving rotation of a switch rotor.

BACKGROUND OF THE INVENTION AND PRIOR ART

In prior art microwave switches where the switch movement is achieved by the intermediary of a Maltese transmission arrangement, the angular position of the switch rotor has been defined by stopping the movement of the second link when this link forms a 90° angle to the first link. In this position, the angular velocity of the switch rotor has fallen to zero. The angular position of the switch rotor is defined by a plurality of component parts, inter alia, the guide member, the slot and the location of the guide member on the driving link. A problem associated with these common Maltese mechanisms is that play occurs when the guide member is displaced in the slot.

A prior art microwave switch of this type is described in U.S. Pat. No. 4,370,631 and comprises a rotor, a rotor housing, two biasing means, a housing for the biasing means and an electronic circuit to control the biasing means. The rotor and the housing are of conventional design. The biasing means comprise two rotary solenoids which are mechanically linked to a Maltese transmission mechanism.

A problem associated with the prior art is that it is difficult to manufacture the components parts with sufficiently high precision to permit the accurate definition of the respective angular position.

Consequently, there is a need for an improved microwave switch which obviates the above-mentioned problems of the prior art.

Accordingly, the object of the present invention is to provide a microwave switch which avoids the need for high tolerance in the above-mentioned parts of the Maltese mechanism.

SUMMARY OF THE INVENTION

The above-mentioned objects are achieved by a microwave switch having the features recited in the appended claims.

The invention is thus based on the insight that one can define the different switch positions of the microwave switch simply and precisely by arranging stop members which are connected to the switch rotor and which engage with stop members which are connected to the switch housing.

According to one aspect of the invention, a microwave switch is provided which is essentially characterized by a first stop member which is fixedly connected to said switch rotor and which is arranged, in the respective switch position, to engage with a second stop member, which is fixedly connected to switch housing;

drive means being arranged, in the respective switch position, to apply a torque to the switch rotor by the intermediary of its shaft and said second link and said first link in order to press said stop members against each other; and the member being arranged to engage with the guide surfaces of said slot in the respective switch position, whereby a lever is created between the rotation shaft of the first link and the guide member and whereby the component force, with which force the guide member engages with the guide surface, obtained from the moment of the drive means, along with said lever, applies said torque to the switch rotor.

According to a further aspect of the present invention, a microwave switch is provided which is essentially characterized by a first stop member which is fixedly connected to said switch rotor and which is arranged, in the respective switch position, to engage with a second stop member, which is fixedly connected to said switch housing; and a means which is arranged, in the respective switch position, to apply a torque to said switch rotor in order to press said stop members against each other.

The microwave switch according to the invention provides several advantages, for example when only a limited amount of space is available for the microwave switch, which is usually the case, the stop members can often be arranged at a greater distance from the rotation shaft of the switch rotor than the rotation shaft of the second link. It will, of course, be appreciated that the farther away from the center of rotation of the switch rotor the "point of contact", which defines the switch position is placed, the simpler it is accurately to define the respective switch position. In the most common case, when the rotation shaft of the second link is arranged adjacent to the circumference portion of the switch rotor and is rotated through 90° between the two switch positions, a factor of $\sqrt{2}$ is "gained" in the distance between the rotation shaft of the switch rotor and the stop members of the switch rotor and the housing, compared to the distance between the rotation shaft of the switch rotor and the end position of the guide member in the slot of the first link.

It is a further advantage that the stop members are not subjected to wear to the same extent as the slot and the guide member. In addition, the angular velocity of the switch rotor is, of course, close to zero in the switch positions when the stop members strike against each other, which further contributes to reducing wear and the subsequent loss of precision.

Yet another advantage is that when the switching takes place, the second arm moves a certain distance prior to engaging with the guide surface of the slot of the guide member, leaving enough time to sense, with the aid of sensors, the movement of the second arm and thus to cut off the transmission of microwaves through the microwave switch before the switch rotor starts to move.

A further important advantage is that it is possible to arrange the respective switch position individually adjustable.

Moreover, it should be noted that U.S. Pat. No. 4,370,631 discloses that the first biasing means drives the movement of the switch rotor by the intermediary of a Maltese mechanism, whereupon the second biasing means brakes the movement of the switch rotor by the intermediary of the Maltese mechanism. The two biasing means are turned off subsequent to driving and breaking, respectively. The two biasing means are thus not designed to achieve a torque which, with the aid of stop members, holds the switch rotor in the respective end position according to the invention.

Further advantages and features can be seen from the description below.

BRIEF DESCRIPTION OF THE DRAWINGS

The present invention will be now described in more detail by way of examples with reference to the accompanying drawings, in which.

DETAILED DESCRIPTION OF PREFERRED EMBODIMENTS

Figures 1, 2:
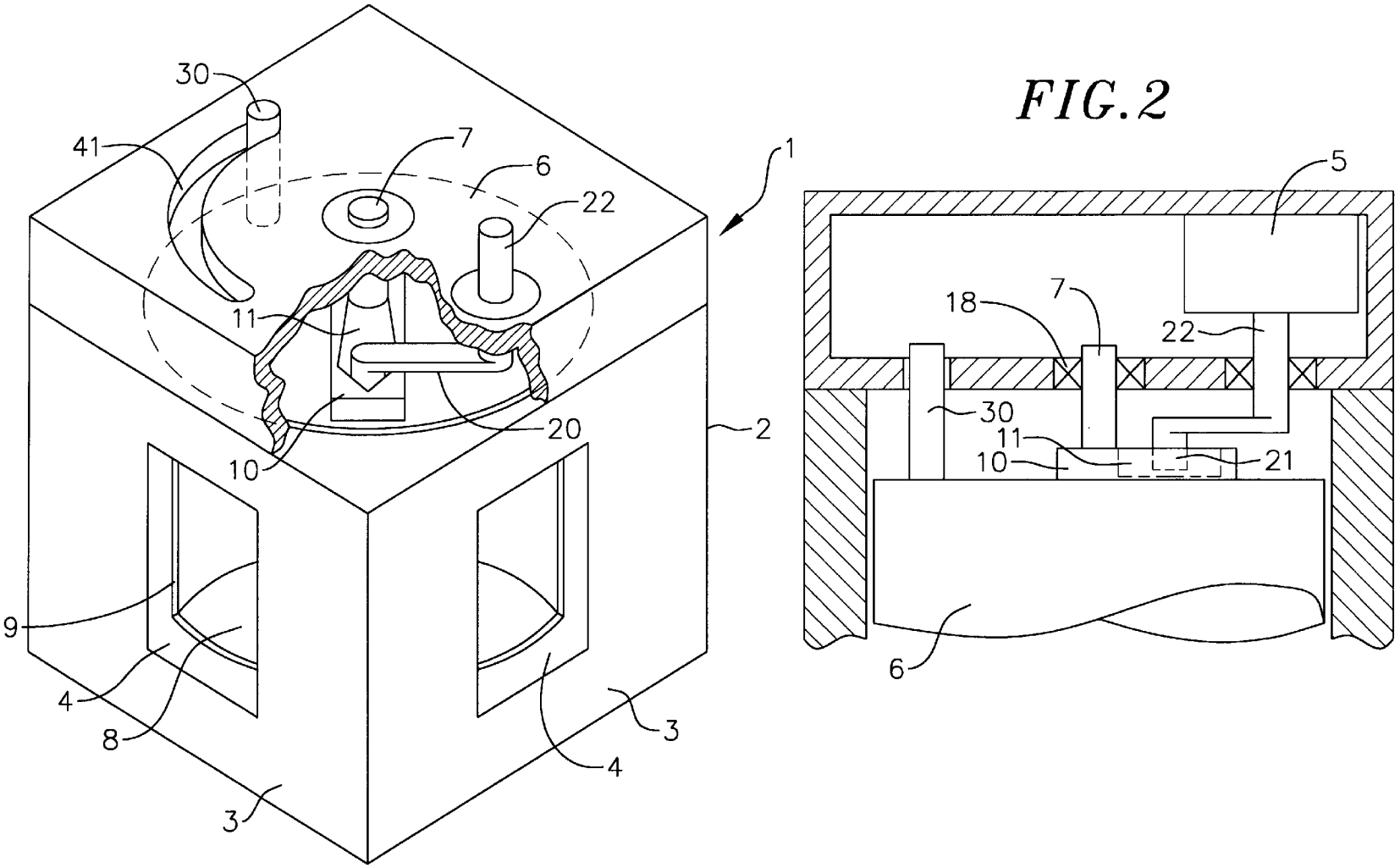
FIG. 1 shows, partly in section, a perspective view of a microwave switch according to a preferred embodiment of the present invention.
FIG. 2 schematically shows a sectional part view of the microwave switch in FIG. 1.
Figure 3:
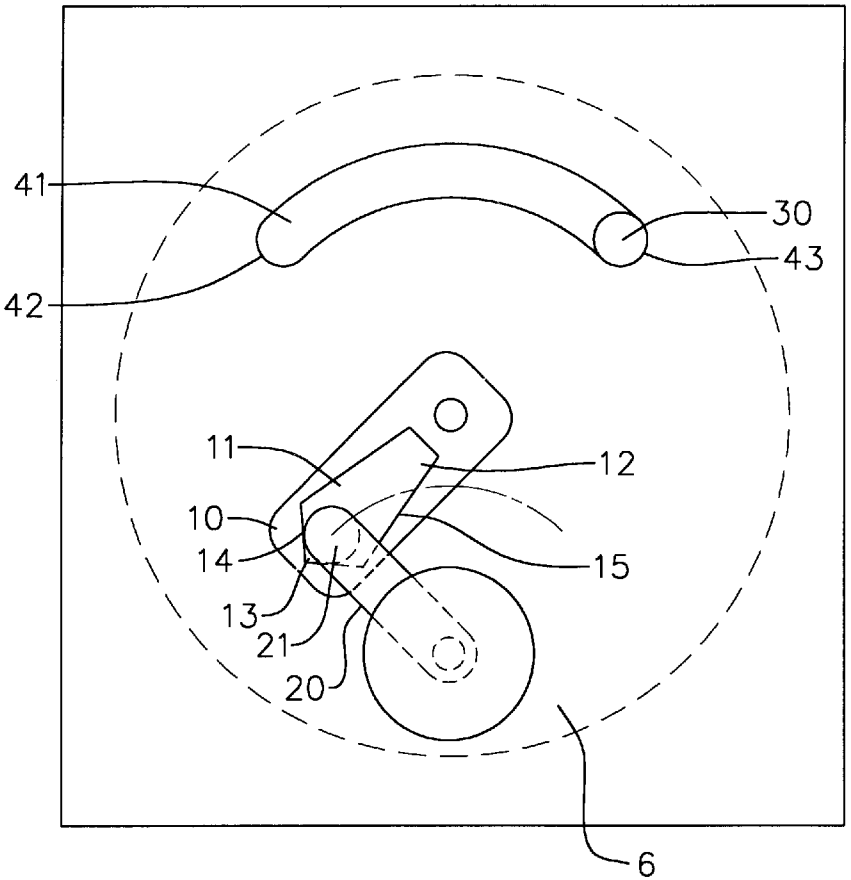
FIG. 3 schematically shows a horizontal section through the microwave switch in FIG. 2 in order to illustrate the operation of the switch rotor.

Reference is first made to FIGS. 1, 2, and 3, which show a microwave switch 1 according to a presently preferred embodiment of the present invention. The microwave switch 1 comprises an essentially cubical switch housing 2 with four side walls 3, in which waveguide connections 4 are arranged and intended for the connection of rectangular waveguides. In the switch housing 2, a switch rotor 6 is suspended on a shaft 7 and is rotatably mounted by means of bearings 18. Furthermore, the switch rotor 6 comprises a pair of bent or arc-shaped waveguide passageways 8 with ports in the usual manner known in the field. Each waveguide passageway 8 is arranged to connect a first and a second waveguide connection 4 of adjacent side walls 3. Further, the switch rotor 6 is arranged to be rotated through 90° between a first switch position and a second switch position in order to, for example, connect the first waveguide connection 4 to a waveguide connection, which is arranged on the side wall opposite the second waveguide connection, and vice versa. Thus, in this embodiment, a waveguide connection in a side wall is always connected to either of the waveguide connections in one of the adjacent side walls. Several variants of this are known in the field and will be appreciated by the person skilled in the field, for example one of the waveguide connections can be plugged up.

Moreover, the microwave switch 1 comprises a drive means 5 fixedly arranged on the switch housing 2 for rotating the switch rotor 6 by the intermediary of a Maltese transmission arrangement. To this end, the transmission arrangement comprises a first arm 10, which is fixed to the shaft 7 of the switch rotor 6, and a second arm 20, which is fixed to or integral with a drive shaft 22 projecting from the drive means 5, which drive shaft is parallel to the shaft 7 of the switch rotor 6.

The first arm 10 comprises, in relation to the shaft 7 of the switch rotor 6, a radially extending slot 11 which is defined by opposite guide surfaces 14 and 15. The slot 11 is substantially drop-shaped and thus exhibits a radial inner portion 12, which has an increasing slot width in an outward radial direction, and a radial outer portion 13, which has a decreasing slot width in an outward radial direction.

In its end portion, the second arm 20 is provided with a guide pin 21, which is parallel to the drive shaft 22 and which is arranged to be slidably moved in said slot 11, the second arm 20 being arranged to form an approximately 90° angle to the first arm 10 in the two switch positions. Further, the guide pin 21 and the slot 11 are designed so that when the two arms 10 and 20 are substantially parallel, i.e. when the guide pin is located at the farthest end of the slot 11, the slot 11 has substantially the same or a somewhat larger slot width compared to the diameter of the guide pin 21.

Furthermore, the microwave switch 1 comprises a stop pin 30 projecting in an axial direction away from the switch rotor 6 arranged on the switch rotor in its circumference portion. The stop pin 30 projects into a stop slot 41 arranged in the switch housing 2, which stop slot extends in an arc-shaped manner 90° circumferentially around the shaft 7 of the switch rotor 6. Moreover, the stop slot 41 and the stop pin 30 are arranged so that the stop pin 30, in the respective switch position, abuts against the respective end portion 42 and 43 of the stop slot.

When the microwave switch 1 is actuated, for example, in order to switch from the switch position shown in the FIG. 1 to the opposite one, the drive means 5 rotates the second arm 20 by the intermediary of the drive shaft 22, the guide pin 21 of the arm 20 being moved in the slot 11. After a certain rotational movement, the guide pin 21 engages with the guide surface 15 of the inner portion 12, the first arm 10 rotating the switch rotor 6 around the shaft 7, with an ever increasing angular velocity of the switch rotor 6, but subsequent to the second arm 20 having rotated the first arm 10 halfway or through 45° (when the two arms are essentially parallel) with a gradually decreasing angular velocity of the switch rotor 6. This means that, initially, the guide pin presses against the guide surface 15 while simultaneously being moved towards the center of rotation of the switch rotor and that when the shafts have been rotated approximately through 45°, the guide pin proceeds to act against the opposite guide surface 14 in order to retard the movement of the switch rotor 6. Since the guide pin 21 has a diameter which is adjusted to the slot 11, the guide pin essentially does not "lose" contact with the slot 11. Consequently, a substantially uniform rotational movement of the switch rotor 6 is obtained.

Just prior to the stop pin 30 striking the end of the stop slot 41, the guide pin 21 loses contact with the guide surface 14 of the inner portion 12 in order to soon thereafter resume contact with the guide surface 15 of the outer portion 13. In this position, the stop pin 30 has reached the end of the stop slot 41 and is pressed against this by the component force from the guide pin 21 acting against the guide surface 15 with a lever from the center of rotation of the first arm 10, i.e. the symmetry axis of the shaft. In addition, by virtue of the force from the guide pin 21 being transmitted at a relatively large angle to the guide surface 15, the problem of the guide pin 21 wedging up in the slot 11 is eliminated. If the slot 11 was manufactured with more parallel or, in the outer portion, less angular guide surfaces 14 and 15, the guide pin 21 might wedge up if it struck the respective guide surface 14 and 15 at a small angle of incidence. The microwave switch 1 can switch back to the switch position shown in FIG. 3 in a corresponding manner.

Figure 4:
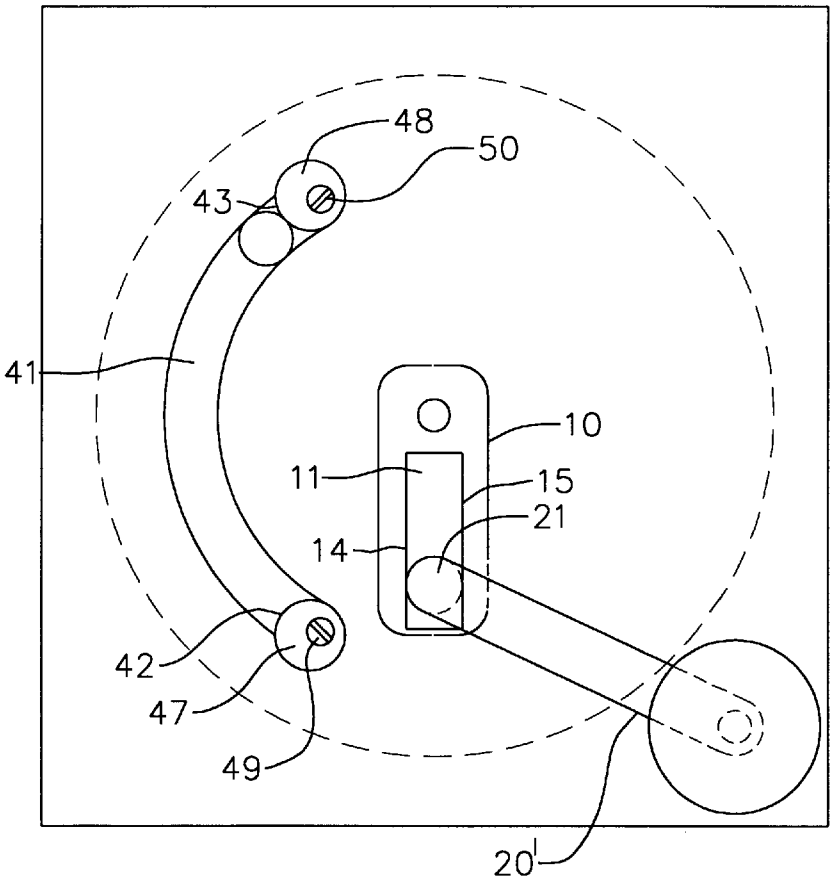
FIG. 4 schematically shows, in a view similar to the one in FIG. 3, a second embodiment of the microwave switch.

FIG. 4 shows a second embodiment of the microwave switch 1, wherein like reference numerals refer to the corresponding components in the preceding Figures. In this embodiment, the first arm 10 comprises a slot 11 with substantially parallel guide surfaces 14 and 15, between which the guide pin 21 can be moved. Further, the second arm 20' is made "too long", which means that, when the first arm 10 has been rotated through 90° from one switch position to the other, the second arm 20' has not been rotated quite as much as the first one. The second arm is dimensioned so that, in this position, it transmits the force from the guide pin 21 at an adequately large angle to the guide surfaces 14 and 15 respectively, in order to efficiently press the switch rotor 6 against the respective end position. Said transmission arrangement is thus arranged so that the guide surfaces 14 and 15 of said slot receive the guide pin 21 at an angle of incidence greater than 0°, i.e. that the angle between the first and second arms 10 and 20' is less than 90° in this case. In addition, it is advantageous for this angle to be sufficiently large in order with certainty to prevent the guide pin 21 from wedging up in the slot 11.

Moreover, in this embodiment, rotatable, eccentric stop members 47 and 48, which can be locked in the desired position by means of screws 49 and 50, are arranged in the end portions 42 and 43 of the slot 41 on the housing 2. These members 47 and 48 are arranged so that the respective switch position can be adjusted individually in order to achieve even greater accuracy.

Figure 5:
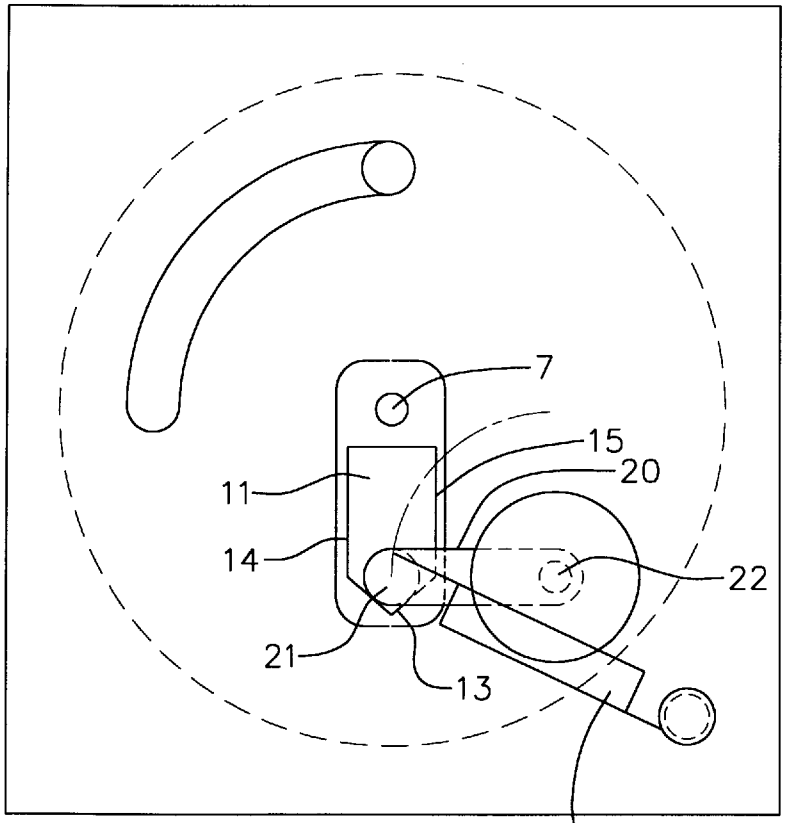
FIG. 5 schematically shows, in a view similar to the one in FIG. 3, a third embodiment of the microwave switch.

FIG. 5 shows a third embodiment of the microwave switch 1, wherein like reference numerals refer to the corresponding components in the preceding Figures. This embodiment is essentially the same as the one in FIG. 2 but differs from the latter in that a tension spring 25 is arranged, in the respective switch position, to act upon the second arm 20 in order to press it against the respective guide surface 14 and 15 of the outer portion 13. For this purpose, the tension spring 25 is fitted with its one end to the second arm 20 adjacent to the guide pin 21 and with its other end to the housing 2 aligned with the shaft 7 and the drive shaft 22. The slot 11 is designed in the same way as the slot in FIG. 3, but lacks the radially inwardly tapering portion 12. Naturally, the arrangement can be designed in a corresponding manner with a pressure spring instead of a tension spring 25.

Figure 6:
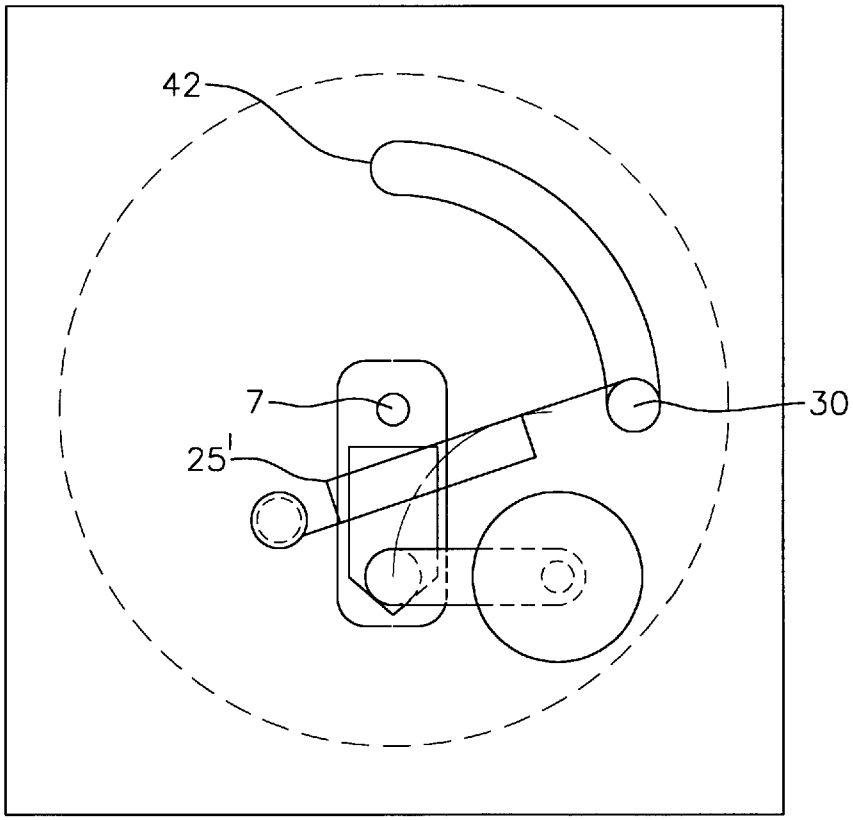
FIG. 6 schematically shows, in a view similar to the one in FIG. 3, a fourth embodiment of the microwave switch.

FIG. 6 shows a fourth embodiment of the microwave switch 1, wherein like reference numerals refer to the corresponding components in the preceding Figures. In this embodiment, a tension spring 25' is fitted with its one end to the stop pin 30 and with its other end to the housing 2 on the opposite side of the shaft 7. The tension spring 25' is thus arranged, in the respective switch position, to press the stop pin 30 against the respective end portion 42 and 43 of the stop slot 41. Accordingly, the tension spring 25 replaces the force from the second arm 20 in the preceding embodiments. Naturally, the arrangement can be designed in a corresponding manner with a pressure spring instead of a tension spring 25.

Figure 7:
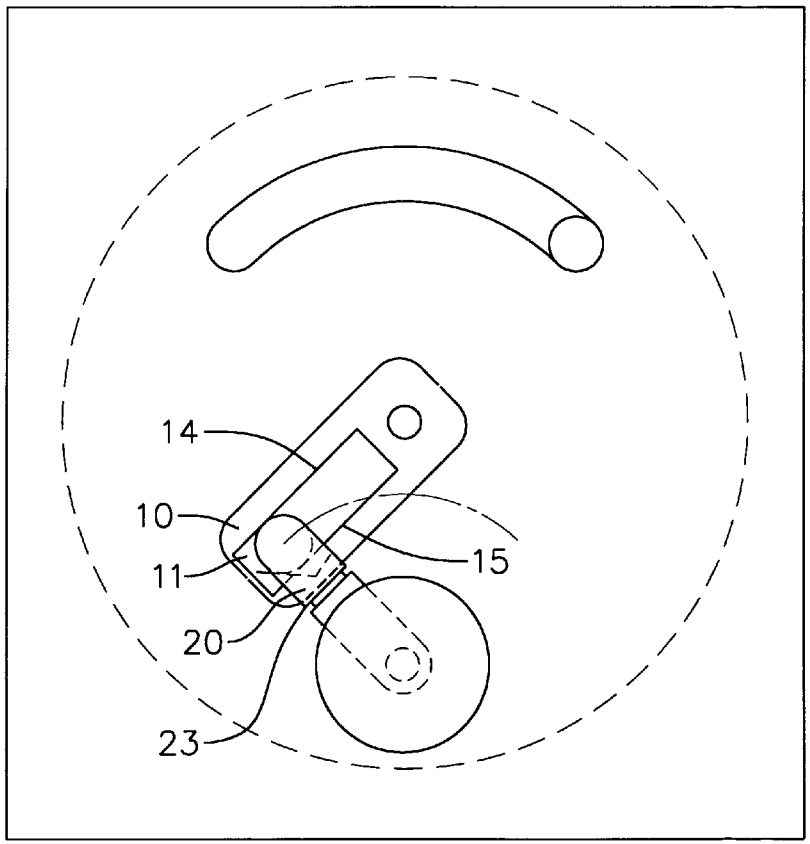
FIG. 7 schematically shows, in a view similar to the one in FIG. 3, a fifth embodiment of the microwave switch.

FIG. 7 shows a fifth embodiment of the microwave switch 1, wherein like reference numerals refer to the corresponding components in the preceding Figures. In this embodiment, the first arm 10 comprises a slot 11 with parallel guide surfaces 14 and 15. As in the embodiment in FIG. 4, the arm 20 is made somewhat "too long", but is made longitudinally resilient with the aid of a spring member 23, for example, in the form of a pressure spring according to the prior art. Consequently, when the first arm 10 has been rotated through 90° from one switch position to another and the stop pin 30 has struck one of the end portions 42 or 43 of the stop slot 41, the second arm 20 has not been rotated quite as much as the first one. In this position, the second arm 20 is rotated somewhat further, the second arm 20 yielding resiliently by virtue of the spring member 23 and a torque being applied to the switch rotor 6 in order to maintain it in either switch position.

Figure 8:
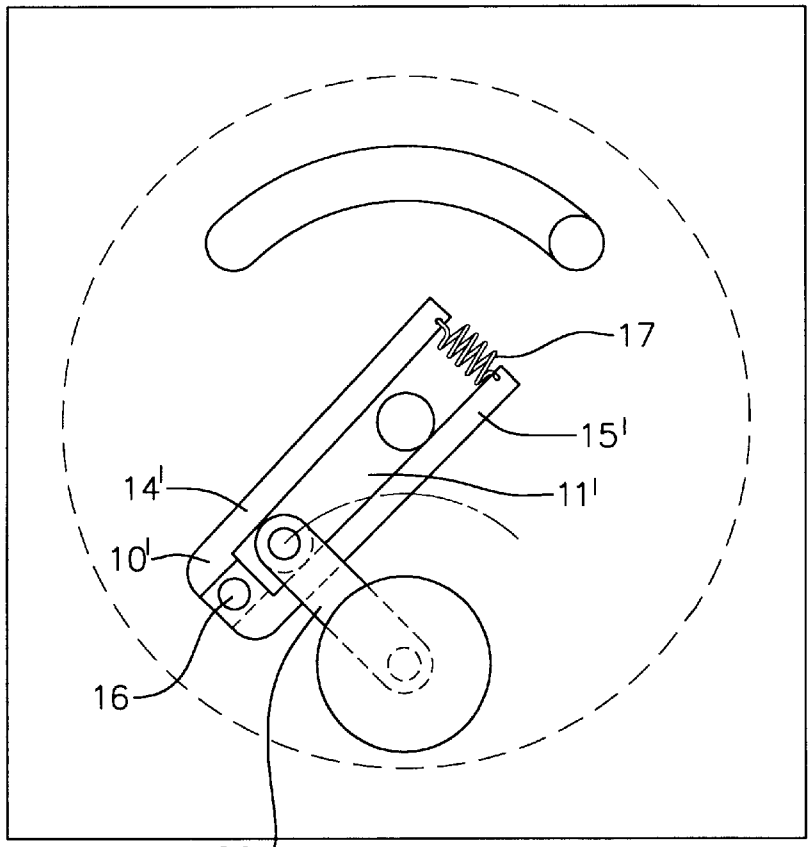
FIG. 8 schematically shows, in a view similar to the one in FIG. 3, a sixth embodiment of the microwave switch.

FIG. 8 shows a sixth embodiment, which is based on the same principles as the one in FIG. 7, of the microwave switch 1, wherein like reference numerals refer to the corresponding components in the preceding Figures. In this embodiment, the first arm 10' comprises two parallel side arms 14' and 15' arranged spaced apart. In one end, the side arms are arranged rotatable around a common pivot 16, which is attached to the upper portion of the switch rotor 6 and which is parallel to the rotation shaft 7 and whose center of rotation is arranged in the circumference portion of the switch rotor 6. Further, the side arms extend radially inwards towards the rotation shaft 7 of the switch rotor 6 and are connected to each other with their other ends with the aid of a tension spring 17. The side arms are thus arranged to form a space or a slot 11', which corresponds to the slot 11 in the preceding embodiments, in which slot 11', the guide pin 21 can be moved radially. Moreover, the second arm 20 is made somewhat "too long", which means that, when the first arm 10' has been rotated through 90° from one switch position to another and the switch rotor 6 has assumed one of the end positions, the second arm 20 has not been rotated quite as much. In this position, the second arm 20 is rotated somewhat further, the respective side arm 14' and 15' yielding resiliently and a torque being applied to the switch rotor 6 in order to maintain it in the switch position.

Figure 9:
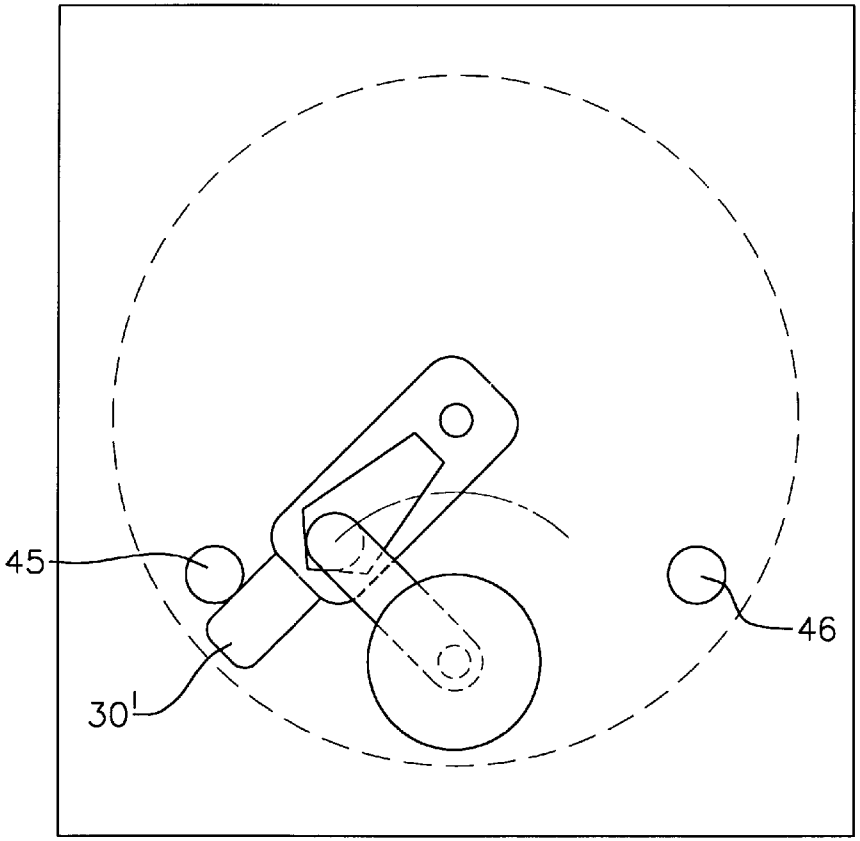
FIG. 9 schematically shows, in a view similar to the one in FIG. 3, a seventh embodiment of the microwave switch.

FIG. 9 shows a seventh embodiment of the microwave switch 1, wherein like reference numerals refer to the corresponding components in the preceding Figures. This embodiment is essentially the same as the embodiment in FIGS. 1 to 3, with the exception that the mechanism defining the switch positions or end positions is differently designed. In this embodiment, the microwave switch 1 comprises a stop arm 30' which projects outside the switch rotor. Moreover, the stop slot 41 in the preceding embodiments has been replaced by two stop lugs 45 and 46 with the same function, which are arranged circumferentially with a 90° angular distance between each other. The stop arm 30' is thus intended to engage with one of the stop lugs 45 and 46 in the respective switch position.

Figure 10:
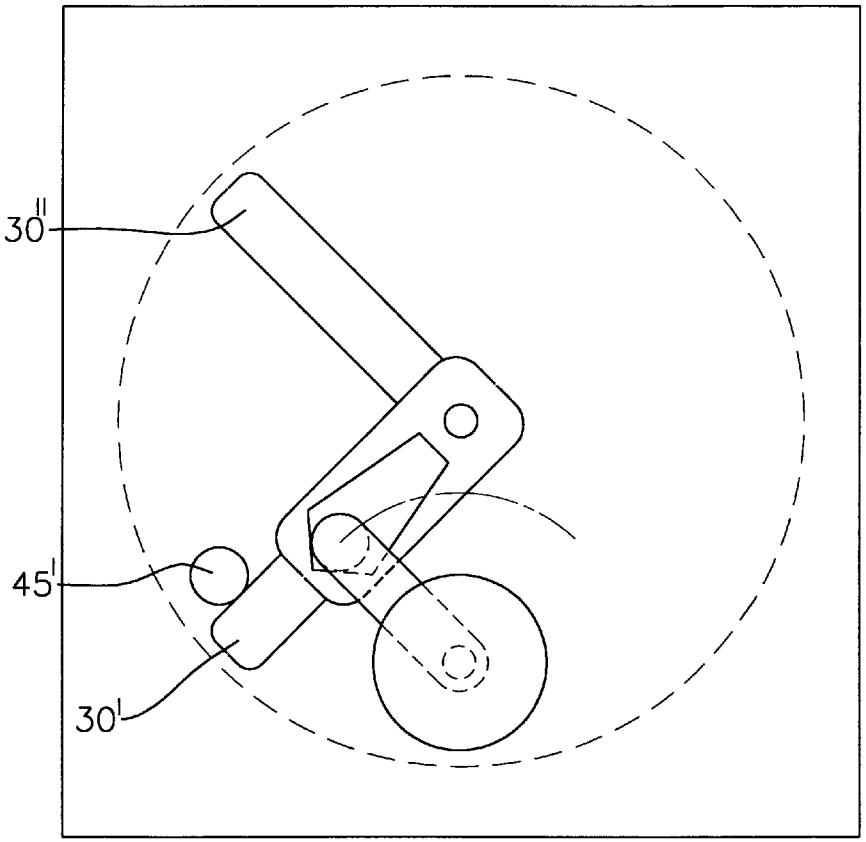
FIG. 10 schematically shows, in a view similar to the one in FIG. 3, an eighth embodiment of the microwave switch.

FIG. 10 shows an eighth embodiment of the microwave switch 1, wherein like reference numerals refer to the corresponding components in the preceding Figures. This embodiment operates according to the same principle as the one in FIG. 9, but instead comprises two stop arms 30' and 30" as well as one single stop lug 45'. The stop arms 30' and 30" are arranged with a 90° angular distance between each other and are intended to engage with the stop lug 45' in the respective switch position.

There are several possible variants of what has been described above, inter alia, the stop lugs 45 and 46 can be designed with corresponding rotatable eccentric members, such as the members 49 and 50 in the embodiment according to FIG. 3, for adjusting the respective switch position. The stop slot and the stop lugs can be arranged in a plurality of different manners, for example on the underside of the switch rotor 6.

The slot 11, for example in the first embodiment, can advantageously be made with rounded-off corners, in order to obtain a more drop-shaped form. Such a form has advantages in terms of manufacturing.

The two arms or links can also be arranged in a plurality of different manners, the slot 11 can, for example, be formed directly in the switch rotor. Nor does the second link have to be driven directly by the drive means, but can obtain its rotational movement by the intermediary of some type of transmission arrangement, for example a toothed gear or an additional Maltese transmission arrangement.

Microwave switches of the type in question are normally provided with two switch positions. Accordingly, the drawings and the description illustrate such an embodiment. However, it will be appreciated that the microwave switch according to the invention can have more than two switch positions, which, for example, is achieved by the arrangement of adjustable stop members, for example professionally designed electromagnetically hinged stop lugs 45 and 46.

The invention is not limited to what has been described above and shown in the drawings, but rather can be altered within the scope of the appended claims.

I claim:

1. A microwave switch comprising:

a switch housing with side walls in which wave-guide connections are arranged;

a switch rotor which is rotatably arranged in the housing between a first switch position and a second switch position;

a drive means which is arranged on the housing with a shaft for achieving a moment for rotating the switch rotor between said switch positions; and a transmission arrangement arranged to transmit the moment of the drive means to the switch rotor, the transmission arrangement comprising a first link, which is fixedly connected to the switch rotor and which comprises, in relation to the rotation shaft of the switch rotor, a radially extended slot which is defined by opposing guide surfaces, and a second link, which is fixed to the shaft, said shaft being parallel to the rotation shaft of the switch rotor, and said second link being fitted with a guide member which is arranged to be slidably moved in said slot, the second link being arranged to form an essentially 90° angle to the first link in the two switch positions, and a first stop member which is fixedly connected to said switch rotor and which is arranged, in the respective switch position, to engage with a second stop member, which is fixedly connected to said switch housing;

wherein said drive means is arranged, in the respective switch position, to apply a torque to the switch rotor by the intermediary of its shaft and said second link and said first link in order to press said stop members against each other; and wherein the guide member is arranged to engage with the guide surfaces of said slot in the respective switch position, whereby a lever is created between the rotation shaft of the first link and the guide member and whereby the component force, with which force the guide member engages with the guide surface, obtained from the moment of the drive means, along with said lever, applies said torque to the switch rotor.

2. A microwave switch comprising:

a switch housing with side walls in which wave-guide connections are arranged;

a switch rotor which is rotatably arranged in the switch housing between different switch positions;

a drive means which is arranged on the housing with a shaft for achieving a moment for rotating the switch rotor between said switch positions; and a transmission arrangement arranged to transmit the moment of the drive means to the switch rotor, the transmission arrangement comprising a first link, which is fixedly connected to the switch rotor and which comprises, in relation to the rotation shaft of the switch rotor, a radially extended slot which is defined by opposing guide surfaces, and a second link, which is fixed to the shaft, which is parallel to the rotation shaft of the switch rotor, and which is fitted with a guide member which is arranged to be slidably moved in said slot, a first stop member which is fixedly connected to said switch rotor and which is arranged, in the respective switch position, to engage with a second stop member, which is fixedly connected to said switch housing; and a torque applying means which is arranged, in the respective switch position, to apply a torque to said switch rotor in order to press said stop members against each other.

3. A microwave switch according to claim 2 wherein said drive means is arranged, in the respective switch position, to apply said torque to the switch rotor by an intermediary of its shaft and said second link.

4. A microwave switch according to claims 2 or 3, wherein said transmission arrangement is designed so that the guide member is arranged to engage with the guide surfaces of said slot in the respective switch position, whereby a lever is created between the rotation shaft of the first link and the guide members, and whereby the component force, with which force the guide member engages with the guide surface, obtained from the moment of the drive means, along with said lever, applies said torque to the switch rotor.

5. A microwave switch according to claims 2 or 3 wherein said first and second link form an essentially 90° angle to each other in the respective switch position.

6. A microwave switch according to any one of claims 2 or 3 wherein the slot comprises a radial outer portion which has a decreasing slot width in an outward radial direction, wherein said guide surfaces in said outer portion are arranged, in the respective switch position, to abut against the guide member, whereby a lever is created between the rotation shaft of the first link and the guide member, and whereby the component force, with which force the guide member engages with the guide surface, obtained from the moment of the drive means, along with said lever, applies said torque to the switch rotor.

7. A microwave switch according to any one of claims 2 or 3 wherein the slot comprises a radial inner portion which has an increasing slot width in an outward radial direction and which, when the guide member is located the farthest in toward the rotation shaft of the switch rotor, exhibits a slot width corresponding to the diameter of the guide member, in order to achieve a uniform rotational movement of the switch rotor.

8. A microwave switch according to any one of claims 2 or 3 wherein said second link is made longitudinally resilient, the second link being arranged, in the respective switch position, to be compressed in order to apply said torque.

9. A microwave switch according to any one of claims 2 or 3 wherein said guide surfaces are arranged, in the respective switch position, to be displaced resiliently in order to apply said torque.

10. A microwave switch according to any one of claims 1, 2 or 3 wherein the torque applying means comprises a spring mechanism arranged, in the respective switch position, to press or pull the stop members against each other.

11. A microwave switch according to any one of claims 1, 2, or 3 wherein said stop members are adjustably arranged.

12. A microwave switch according to claim 10 wherein the spring mechanism comprises a tension spring.

13. A microwave switch according to claim 10 wherein the spring mechanism comprises a tension spring to pull the stop members against each other.

14. A microwave switch according to claim 1 wherein said stop members are adjustably arranged by rotatable eccentric members.

15. A microwave switch according to claim 2 wherein said stop members are adjustably arranged by rotatable eccentric members.

16. A microwave switch according to claim 3 wherein said stop members are adjustably arranged by rotatable eccentric members.

* * * * *

UNITED STATES PATENT AND TRADEMARK OFFICE

CERTIFICATE OF CORRECTION

PATENT NO. : 5,973,577
DATED : October 26, 1999
INVENTOR(S) : Anders Karlsson

It is certified that error appears in the above-identified patent and that said Letters Patent is hereby corrected as shown below:

On the title page, item [73], the Assignee should read:
-- [73] Assignee: Sivers Lab AB, Kista, Sweden --

Column 1, lines 63-65, delete the paragraph beginning with "The above-mentioned objects" to and including " appended claims."
Column 2, line 15, before "member" insert -- guide --.
Column 3, line 7, replace "breaking" with -- braking --.
Column 8, line 44, replace "guide members" with -- guide member --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*